US008623302B2

(12) United States Patent
Chuntonov

(10) Patent No.: US 8,623,302 B2
(45) Date of Patent: Jan. 7, 2014

(54) BARIUM CONTAINING GRANULES FOR SORPTION APPLICATIONS

(75) Inventor: Konstantin Chuntonov, Nesher (IL)

(73) Assignee: Reactive Metals Ltd., Seoul (KR)

( * ) Notice: Subject to any disclaimer, the term of this patent is extended or adjusted under 35 U.S.C. 154(b) by 0 days.

(21) Appl. No.: 13/393,671

(22) PCT Filed: Sep. 2, 2010

(86) PCT No.: PCT/IL2010/000722

§ 371 (c)(1),
(2), (4) Date: Oct. 8, 2012

(87) PCT Pub. No.: WO2011/027345

PCT Pub. Date: Mar. 10, 2011

(65) Prior Publication Data

US 2013/0039825 A1 Feb. 14, 2013

Related U.S. Application Data

(60) Provisional application No. 61/272,249, filed on Sep. 4, 2009.

(51) Int. Cl.

| | |
|---|---|
| ***B01D 53/34*** | (2006.01) |
| ***C01D 13/00*** | (2006.01) |
| ***C01F 11/00*** | (2006.01) |
| ***C01F 1/00*** | (2006.01) |
| ***C09K 3/00*** | (2006.01) |

(52) U.S. Cl.

USPC ..... 423/111; 423/155; 423/179; 423/210; 252/181.4; 252/181.7; 252/184; 428/402

(58) Field of Classification Search

USPC ..... 423/210, 111, 155, 179; 252/181.4, 252/181.7, 184; 313/561; 428/402; 75/352

See application file for complete search history.

(56) References Cited

U.S. PATENT DOCUMENTS

| | | | | |
|---|---|---|---|---|
| 4,665,343 | A | 5/1987 | Ferrario et al. | |
| 5,312,606 | A | 5/1994 | Boffito et al. | |
| 5,312,607 | A | 5/1994 | Schiabel et al. | |
| 2006/0225817 | A1 | 10/2006 | Chuntonov | |
| 2008/0128656 | A1 * | 6/2008 | Thollon et al. | 252/373 |
| 2013/0039825 | A1 * | 2/2013 | Chuntonov | 423/210 |

FOREIGN PATENT DOCUMENTS

| | | |
|---|---|---|
| EP | 1 821 328 | 8/2007 |
| WO | 2009053969 | 4/2009 |

OTHER PUBLICATIONS

International Search Report for PCT/IL2010/000722 mailing date Jan. 27, 2011—3 pages.

* cited by examiner

*Primary Examiner* — Timothy Vanoy
(74) *Attorney, Agent, or Firm* — Hamre, Schumann, Mueller & Larson, P.C.

(57) ABSTRACT

A method for preparation of a getter material on the basis of intermetallic compounds of barium is described. The method comprises preparing a melt of a ternary mixture containing barium, metal and sodium; directionally solidifying the melt to produce a textured ingot; granulating the textured ingot, thereby obtaining granules having open-ended voids extending therethrough; and evaporating the sodium from the granules by applying a thermovacuum treatment to the granules. The textured ingot comprises a getter body made of intermetallic compounds of barium; and open-ended voids within the getter body.

21 Claims, 6 Drawing Sheets

BARIUM CONTAINING GRANULES FOR SORPTION APPLICATIONS

CROSS REFERENCE TO RELATED APPLICATIONS

The present application is a National Stage of International Application No. PCT/IL2010/000722, filed on Sep. 2, 2010, which claims priority to U.S. Provisional Patent Application No. 61/272,249, filed on Sep. 4, 2009, the entire contents of which are being incorporated herein by reference.

FIELD OF THE INVENTION

The given invention relates to getter materials for sorbing residual gases, and in particular, to barium containing granules for sorbing residual gases in vacuum devices and for purification of gases from active gas impurities.

BACKGROUND OF THE INVENTION

The use of getter materials for removing residual gas molecules from a vacuum and for purification of gases from active gas impurities is well known. These materials can, for example, absorb or react with the residual gases and gas impurities when they are placed inside a vacuum device.

There are applications of getter materials, where they have to show maximum high sorption capacity at room or close to room temperature. Such can, for example, be the case of sealed-off chambers in micro- or optoelectronics, portable analytical devices, e.g., gas chromatography-mass spectrometry (GC-MS) detectors, gas purifiers used in the production of high purity gases, etc.

It is known that transitional metals, which are the basis of commonly used getters, can capture most active gases at room temperature only by adsorption. Accordingly, their effectiveness or, in other words, their relative sorption capacity $C_r$, (which is proportional to the value $r^{-1}$, where r is a typical size of a getter body, e.g., the radius of a continuous particle, the thickness of continuous film, etc.) is extremely small, which creates significant difficulties, when such getter materials are used.

On the other hand, many different alloys of barium and/or lithium with stable in the air metals, belong to substances, which can sorb oxygen, nitrogen and other gases with the sufficient for practical needs rate without heating. In contrast to transition metals, such barium and/or lithium alloys can react with gases to completion, (i.e., $C_r$~1), thereby forming a layer of products on the surface of the getter material. Such a layer can further grow in accordance with the diffusional kinetics. However, the employment scale of barium and lithium in getter technologies is hitherto very limited.

For example, U.S. Pat. Nos. 5,312,606 and 5,312,607 to Boffito and Schiabel describe the processes for the sorption of residual gas in a vessel by means of a non-activated, non-evaporated barium getter. These processes comprise the steps of reducing alloys of barium as well as barium and lithium to a particle size of less than 5 mm, under vacuum or an inert gas atmosphere and then placing the particulate alloy in the vessel. Upon exposing the particulate alloy to the residual gas in the vessel at room temperature the gas is sorbed.

It should be understood that the material described in U.S. Pat. Nos. 5,312,606 and 5,312,607 has a continuous cast structure and widespread in the particle size distribution. Accordingly, such a material is not able to provide reproducibility and stability of the sorption process over time.

U.S. Pat. Appl. Pub. No. 2006/0225817 to Chuntonov describes a method for obtaining of skeleton-type granules of an alloy $A_nMe_m$ with high concentration of alkaline-earth metal A by evaporation of its excess from cast shot under vacuum.

International Patent Appl. WO2009/053969 to Chuntonov describes a lithium based getter material with high surface area. The material is manufactured in the form of granules of 0.2 mm to 2.5 mm in diameter with the structure of a dendritic carcass. This material has a relatively high sorption capacity and resistance to chemical shocks.

It should be noted that although the getter materials described in US2006/0225817 and WO2009/053969 provide a relatively constant sorption rate over almost the entire operating time of the material, the technology of dispersion of chemically active melts containing a volatile component is quite complex and requires special skills and knowledge from an operator.

GENERAL DESCRIPTION OF THE INVENTION

Despite the known techniques in the area of getter materials operating at ambient temperatures, there is a need in the art for, and it would be useful to have a novel getter material with enhanced sorption capacity produced by a relatively easy and reliable method.

The Applicants found that a number of barium (Ba) based intermetallic compounds of the composition $BaMe_2$ and BaMe (or some other compounds which are close to Ba intermetallic compounds in the stoichiometry), which crystallize into the structures of Laves phases type or into structures similar to the structures of $AlB_2$, CrB type, behave similarly to lithium (Li) solid solutions in sorbing gases. In particular, both (Ba based getter materials and Li based getter materials) have a moderate reactivity, when compared to pure Ba and Li. When these getter materials react with gases, they form on their surface a layer of products reducing the sorption kinetics and protecting the material from fast chemical destruction.

Moreover, the Applicants found that all these getter materials can react with gases until the entire active component is consumed. However, a mechanism for the reactions (in which the entire active component is consumed) for the Ba based getter materials is different from the mechanism of reaction for Li based getter materials. In particular, the materials based on barium alloys react in this manner due to the peculiarities of their crystal structure, whereas the materials based on lithium alloys react due to the high mobility of lithium atoms in the lattice of the metal-dissolvent.

The fact that $BaMe_2$ and BaMe alloys possess moderate reactivity is important for the purpose of the present application, as it provides these alloys with considerable advantages over pure barium for practical usage. However, for the process in which the entire active component is consumed to develop, two conditions have to be fulfilled. One of them requires that the intermetallic compounds $BaMe_2$ or BaMe should belong to the structural type of Laves phases or the structural type of $AlB_2$, CrB. The second requirement defines dimensional restriction. Thus, in accordance with this requirement, to make the sorption process occur over reasonable and desirable time periods, the dispersity of the getter material should satisfy the ratio of $10^{-1}$ μm≤r≤$10^2$ μm, where r is the characteristic size of the getter body (i.e., r can, for example, be the film thickness on a substrate, the radius of the isolated particle of a getter material, and/or a dimension of voids in a getter body, etc.)

The present application partially eliminates disadvantages of conventional getter materials and provides novel gas permeable getter materials based on intermetallic compounds $BaMe_2$ and/or BaMe having the microstructure meeting the aforementioned dispersity requirement. Examples of metals (Me), which form intermetallic compounds with Ba (with the structure favorable for the sorption applications) include, but are not limited to, Ag, Al, Ga, In, Mg, Pb, Si. Taking into account the price of metal, its toxicity, as well as the character of the phase equilibriums in the corresponding systems Ba-Me, the following alloys for the production of the initial alloys were selected:

$(Al_{1-x}Ba_x)_{1-y}Na_y$, where $0.37 \le x \le 0.40$, $0.05 \le y \le 0.15$; and $(Ba_xMg_{1-x})_{1-y}Na_y$, where $0.27 \le x \le 0.33$, $0.05 \le y \le 0.15$.

The preparation of the getter materials of the present application uses vertical directional solidification of the melt of a ternary mixture containing barium, metal and sodium in a crucible for obtaining a textured ingot. The growth texture of the ingot is characterized by a solid getter body having a primary crystal intermetallic phase, and an eutectic filling with a volatile metallic phase of the spaces between the crystals of the primary phase. One of these phase constituents of the mentioned eutectics is sodium.

The directional solidification can, for example, be carried out in a two-zone vertical apparatus of Stockbarger's type in a dedicated growth device. According to an embodiment of the present invention, the growth device comprises a crucible tube having a metallic or graphitic thin wall, and a mould including a pile of disks tightly adjacent to one another. Each disk of the mould comprises one or more through holes having a predetermined shape and arranged coaxially of the through holes of the adjacent disks. The disks are fixed in the crucible tube in the position when all the through holes are coaxially aligned, and thereby they form a serially ordered set of vertical channels, which are filled with the alloy melt.

Further, the preparation method includes the step of granulating the ingot in a glove box in argon atmosphere for obtaining granules having open-ended voids extending therethrough. The granules can have cylindrical, semispherical and/or cone shape with pronounced growth texture, which appears at multiphase solidification under conditions of directional heat removal.

According to an embodiment of the present invention, the granules have a getter body made of intermetallic compounds of barium ($BaMe_2$ and/or BaMe) and open-ended voids within the getter body filled with sodium. As a result of the directional solidification, the open-ended voids extend along a longitudinal axis of the textured ingot.

At the finishing stage these granules are subjected to thermovacuum treatment for evaporating the sodium therefrom. The sodium can, for example, be evaporated under pressure of about $10^{-6}$ mbar and at temperature of less than 250° C.

After the vacuum evaporation of the volatile sodium phase, these granules obtain the final structure having open-ended voids, which provides the structural dispersion of the getter material of the present application allowing gas molecules to penetrate inside the granulated getter material for sorption therein.

Thus according to one general aspect of the present application, there is provided a method for preparation of a getter material on the basis of intermetallic compounds of barium. The method comprises preparing a melt of a ternary mixture containing barium, metal and sodium; directionally solidifying the melt to produce a textured ingot; granulating the textured ingot, thereby obtaining granules having open-ended voids extending therethrough; and evaporating the sodium from the granules by applying thermovacuum treatment to the granules. The textured ingot comprises a getter body made of intermetallic compounds of barium, and the open-ended voids within the getter body. The open-ended voids extend along a longitudinal axis of the textured ingot and are filled with sodium.

According to one embodiment, the ternary mixture is selected from $(BaMe)_{1-y}Na_y$ and $(BaMe_2)_{1-y}Na_y$, where $0.05 \le y \le 0.15$.

According to one embodiment, the ternary mixture is selected from $(Al_{1-x}Ba_x)_{1-y}Na_y$, where $0.37 \le x \le 0.40$, $0.05 \le y \le 0.15$; and $(Ba_xMg_{1-x})_{1-y}Na_y$, where $0.27 \le x \le 0.33$, $0.05 \le y \le 0.15$.

According to one embodiment, the preparing of the melt of the mixture of the intermetallic compounds of barium together with sodium comprises:

providing an alloy of a ternary mixture containing barium, metal and sodium;

providing a mould having a mould cavity of a predetermined shape;

arranging the alloy of the ternary mixture above the mould cavity;

sealing the arrangement comprising the alloy arranged above the mould in an ampoule in a vacuum; and maintaining the ampoule at a first temperature having a value exceeding the liquidus point of the melt as long as required for obtaining the alloy of the ternary mixture in a liquid state, thereby allowing the melt to flow into the mould cavity.

According to an embodiment, the method for preparation of the getter material further comprises providing a metal gauze and arranging the metal gauze along a wall of the mould cavity before arranging the alloy of the ternary mixture above the mould cavity in the crucible tube, thereby to envelop the melt with the metal gauze after the maintaining the ampoule at the first temperature.

According to an embodiment, the directional solidification of the melt includes subjecting the ampoule with the melt to a second temperature gradually along its length at a predetermined rate as long as required for obtaining the textured ingot having the getter body of an intermetallic phase and the open-ended voids filled with sodium. The second temperature has a value below the solidus point of the melt.

According to another embodiment, the preparing of the melt of the mixture of the intermetallic compounds of barium together with sodium comprises:

providing an alloy of a ternary mixture containing barium, metal and sodium;

providing a mould having a mould cavity of a predetermined shape;

providing a crucible tube;

arranging the alloy of said ternary mixture above the mould cavity in the crucible tube;

placing the arrangement comprising the crucible tube containing the alloy arranged above the mould in an argon atmosphere; and maintaining the crucible-tube in the argon atmosphere at a first temperature having a value exceeding the liquidus point of the melt as long as required for obtaining the alloy of the ternary mixture in a liquid state, thereby allowing the melt to flow under gravity into the mould cavity.

According to an embodiment, the method for preparation of the getter material further comprises providing a metal gauze and arranging the metal gauze along a wall of the mould cavity before the placing of the arrangement in an the crucible-tube, thereby to envelop the melt with the metal gauze after the maintaining of the ampoule at the first temperature.

According to an embodiment, the directional solidification of the melt includes subjecting the crucible-tube with the melt in an argon atmosphere to a second temperature gradually along its length at a predetermined rate as long as required for obtaining the ingot having the getter body of an intermetallic phase and the open-ended voids filled with sodium.

According to an embodiment, the first temperature is higher than the liquidus point of the melt by 40-60 degrees Celsius, whereas the second temperature is less than the solidus point of the melt by 10-20 degrees Celsius.

According to an embodiment, the mould comprises a vertically stacked array of disks. Each disk comprises at least one through hole having a predetermined shape and arranged coaxially of the through hole of the adjacent disks, thereby forming the mould cavity.

According to an embodiment, a radial dimension of at least a portion of the through holes changes along a hole length.

According to an embodiment, the granulating of the textured ingot comprises separating the disks of the plurality of disks from each other; and disengaging parts of the textured ingot located within the through holes of the adjacent disks from the disks.

According to an embodiment, the evaporating of the sodium from the voids is carried out at a pressure of about $10^{-6}$ mbar and at a temperature in the range of 200° C.-250° C.

According to another general aspect of the present application, there is provided a getter material on the basis of intermetallic compounds of barium, comprising granules having a getter body made of the intermetallic compounds, and open-ended voids extending therethrough, thereby defusing sorption channels.

According to an embodiment, the granules have substantially regular shapes and uniform dimensions.

According to an embodiment, the dimension of the granules is in the range of 3 mm to 12 mm.

According to an embodiment, a distance between the open-ended voids extending through the granules is in the range of about 1 micrometer to about 100 micrometers.

According to an embodiment, the getter material of the present invention further comprises a metal gauze enveloping at least partially the granules.

According to a still another general aspect of the present application, there is provided a process of gettering of residual gases in a vacuum chamber. The gettering process comprises the step of providing a sorption pump comprising a getter material described above; and connecting the sorption pump to a vacuum line of the vacuum chamber.

According to a further general aspect of the present application, there is provided a process of purification of a gas stream. The purification process comprises the step of flowing a gas of the gas stream through a getter material described above.

There has thus been outlined, rather broadly, the more important features of the invention in order that the detailed description thereof that follows hereinafter may be better understood. Additional details and advantages of the invention will be set forth in the detailed description, and in part will be appreciated from the description, or may be learned by practice of the invention.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 2A:
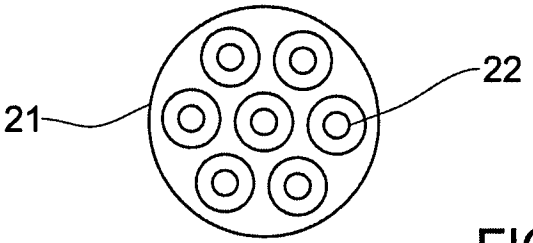
FIG. 2A is a schematic top view of the growth device shown in FIG. 1.

The principles of the getter material and method according to the present invention may be better understood with reference to the drawings and the accompanying description, wherein like reference numerals have been used throughout to designate identical elements. It being understood that these drawings which are not necessarily to scale and proportions, are given for illustrative purposes only and are not intended to limit the scope of the invention. Examples of constructions, materials, dimensions, and manufacturing processes are provided for selected elements. Those versed in the art should appreciate that many of the examples provided have suitable alternatives which may be utilized.

According to one general aspect, the present disclosure provides a method for preparation of a getter material on the basis of intermetallic compounds of barium. The method includes the step of preparing a melt of a ternary mixture containing barium, metal and sodium and fabricating granules from this melt by directional solidification of Ba alloys in a special growth device. The growth device is designed in such a manner that granules obtained by the method of the application have substantially regular shapes and uniform dimensions. These granules are afterwards subjected to heat treatment in a vacuum to make them permeable for gases.

The alloy used for the purpose of the present invention contains sodium as an obligatory component in the amount exceeding its maximum solubility in the products of solidification. During the directional solidification of the melt, excess sodium is pushed by the solidification front into spaces between the growing crystals of the primary intermetallic phase and solidifies there as one of the phase constituents of a binary or ternary eutectic. After the evaporation of this volatile phase, end-to-end channels are formed in the body of the granule. These channels extend parallel to the ingot axis throughout the entire volume and allow access to the inside areas of the material for the gas molecules.

In other words, as a result of directional solidification of the melt, a textured ingot is produced. The textured ingot comprises a getter body made of intermetallic compounds of barium, and open-ended voids within the getter body. The open-ended voids extend along a longitudinal axis of the textured ingot and are filled with sodium.

Figure 1:
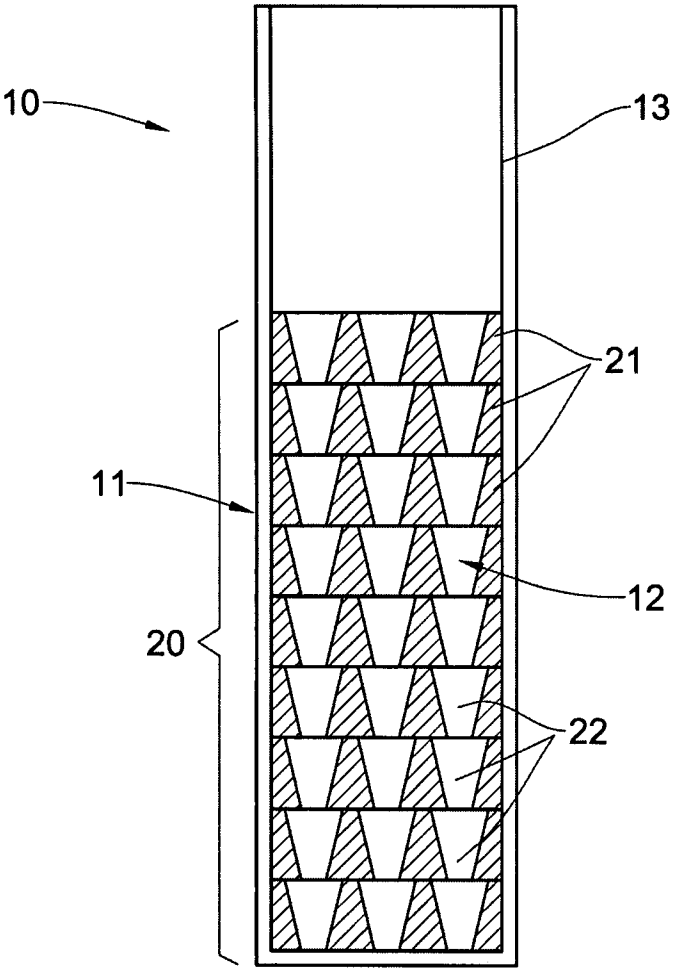
FIG. 1 is a schematic side cross-sectional view of a growth device for preparation of a getter material, according to one embodiment of the present invention.

Referring to FIG. 1, a growth device 10 for preparation of a getter material is shown, according to one embodiment of the present invention. The growth device 10 includes a mould 11 having a mould cavity 12 of a predetermined shape.

Referring to FIG. 2A, the mould (11 in FIG. 1) includes a vertically stacked array 20 of disks 21. The material for the disks is chosen to be compatible with the melt. Examples of materials suitable for the discs 21 include, but are not limited to molybdenum, stainless steels, graphite, etc.

Each disk comprises one or more through holes 22 having a predetermined shape. Although seven through holes are shown in FIG. 2A, the number of the through holes in the disks can be different, depending on the diameter of the disk and on the diameter of the holes.

Figure 2B:
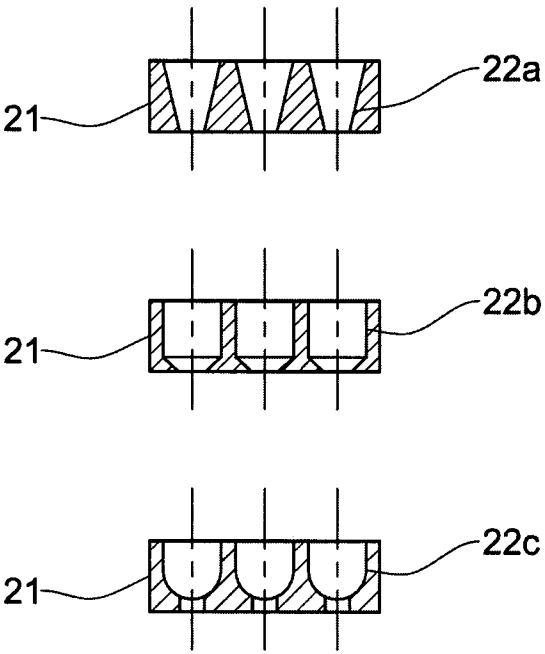
FIG. 2B is a schematic side cross-sectional view of disks of a vertically stacked array of the growth device shown in FIG. 1.

Three shapes of the through holes are shown in FIG. 2B for the disks 21; however, other shapes are also contemplated. According to an embodiment, the diameter of the through holes changes along the hole's length. Specifically, the through hole 22*a* has a tapered shape, the through hole 22*b* has a cylindrical shape with a tapered neck, whereas the through hole 22*c* has a semispherical shape with a cylindrical neck.

The holes 22*a*, 22*b* and 22*c* are arranged in the vertically stacked array 20 coaxially with one another. In particular, each through hole is coaxial with the corresponding through hole of the adjacent disks. All the holes 22, 22*a*, 22*b* and 22*c* together define the mould cavity (12 in FIG. 1) in the mould (11 in FIG. 1).

According to an embodiment of the invention, the vertically stacked array 20 is arranged in a crucible tube (13 in FIG. 1). The crucible tube has a relatively thin wall and can, for example, be made from graphite, stainless steel, etc.

The production of granules begins by (i) providing a melt of a ternary mixture containing barium, metal and sodium in a glove box (not shown) in an argon (Ar) atmosphere, and (ii) directionally solidifying the melt in the cavity 12 of the mould 11 to produce a textured ingot. According to one embodiment, the ternary mixture is selected from $(BaMe)_{1-y}Na_y$, where $0.05 \le y \le 0.15$. For example, the ternary mixture is selected from $(Al_{1-x}Ba_x)_{1-y}Na_y$, where $0.37 \le x \le 0.40$, $0.05 \le y \le 0.15$. According to another embodiment, the ternary mixture is selected from $(BaMe_2)_{1-y}Na_y$, where $0.05 \le y \le 0.15$. For example, $(Ba_xMg_{1-x})_{1-y}Na_y$, where $0.27 \le x \le 0.33$, $0.05 \le y \le 0.15$.

Figure 3:
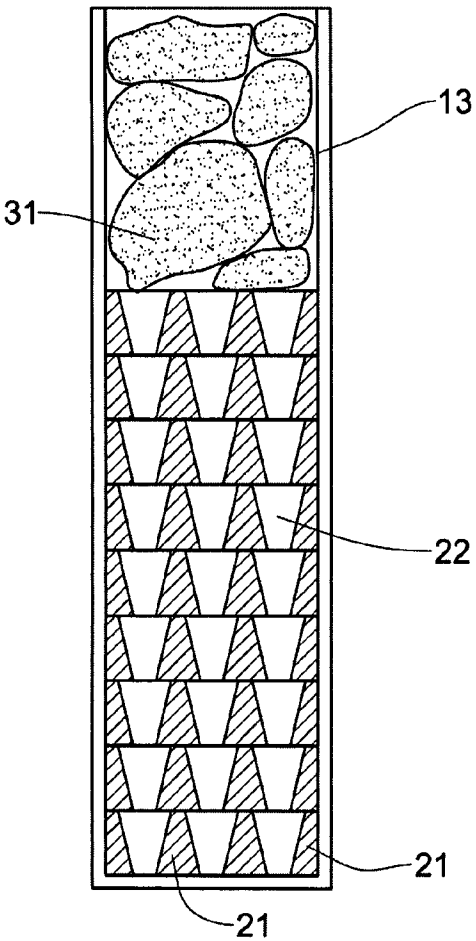
FIG. 3 is a schematic side cross-sectional view of the growth device shown in FIG. 1 filled with an alloy, according to one embodiment of the present invention.

Referring to FIG. 3, an alloy of a ternary mixture containing barium, metal and sodium in the form of one or more pieces 31 is placed above the mould in the crucible tube 13. The mould 11 comprises the vertically stacked array 20 of the disks 21 having through holes of a predetermined shape.

Generally, many variants of vertical directional solidification are suitable for producing a textured ingot made of a ternary mixture containing barium, metal and sodium. Two particular cases are described hereinbelow, which take into consideration the peculiarities of handling chemically active and volatile materials.

Figure 4:
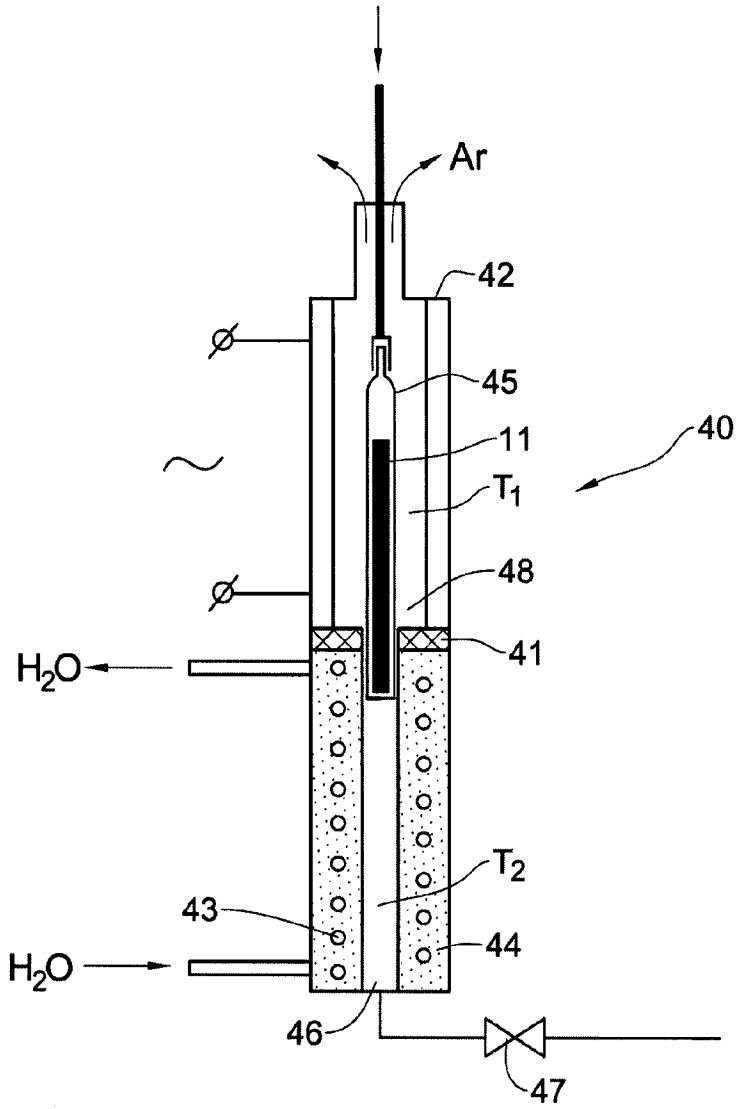
FIG. 4 is a schematic view of an apparatus for directional solidification of alloys of a ternary mixture containing barium, metal and sodium in a vacuum, according to one embodiment of the present invention.

According to one embodiment of the invention, the melting of the ternary mixture, and vertical directional solidification of the melt, is carried out in vacuum. Referring to FIG. 4, a schematic view of an apparatus 40 for directional solidification of melts of a ternary mixture containing barium, metal and sodium in vacuum is shown, according to an embodiment of the present invention. The apparatus 40 comprises a high temperature zone $T_1$ and a low temperature zone $T_2$ separated from the high temperature zone $T_1$ by a partition 41 made of a thermal insulation material. The high temperature zone $T_1$ contains an electric furnace 42. The low temperature zone $T_2$ contains a pipe coil 43 with a cooling agent (e.g., flowing water), and a filler 44 made of a high thermal conductivity material filling the low temperature zone $T_2$.

According to one embodiment of the present invention, a mold 11 is arranged in a metallic ampoule 45, and an alloy of the ternary mixture is placed above the mould cavity. Thereafter, the metallic ampoule 45 is sealed in a vacuum.

According to another embodiment, the crucible tube (13 in FIG. 3) is sealed in a metallic ampoule 45 in a vacuum. The sealing can, for example, be carried out in accordance with the technique described by K. A. Chuntonov et al., J. Less-Common Metals, 1982, V. 83, P. 143-153.

After sealing, the metallic ampoule 45 is placed vertically in the tubular furnace 42 of the high temperature zone $T_1$, where the ampoule is maintained at a first temperature having a value exceeding the liquidus point of the melt. The first temperature can, for example, be higher than the liquidus point of the melt by 40-60 degrees Celsius.

The ampoule 45 is maintained at the first temperature as long as required for obtaining the alloy of the ternary mixture in a liquid state. A neutral atmosphere in the furnace is desirable and it can be provided by feeding Ar into a channel 46 of the furnace through a valve 47. As a result of the heating, the alloy melts, and thereby flows by gravity into the mould cavity to fills up the through holes (22 in FIG. 3) of the disks (21 in FIG. 3).

Thereafter, the ampoule 45 is moved down into the low temperature zone $T_2$ to directionally solidify the melt. Solidification of the alloy starts after the bottom end of the ampoule 45 passes through an orifice 48 in the partition 41. The ampoule 45 with the melt is subjected to a second temperature gradually along its length at a predetermined rate as long as required for obtaining the textured ingot. The second temperature can, for example, be less than the solidus point of the melt by 10-20 degrees Celsius. The textured ingot has a getter body of an intermetallic phase and the open-ended voids are filled with sodium.

Figure 5:
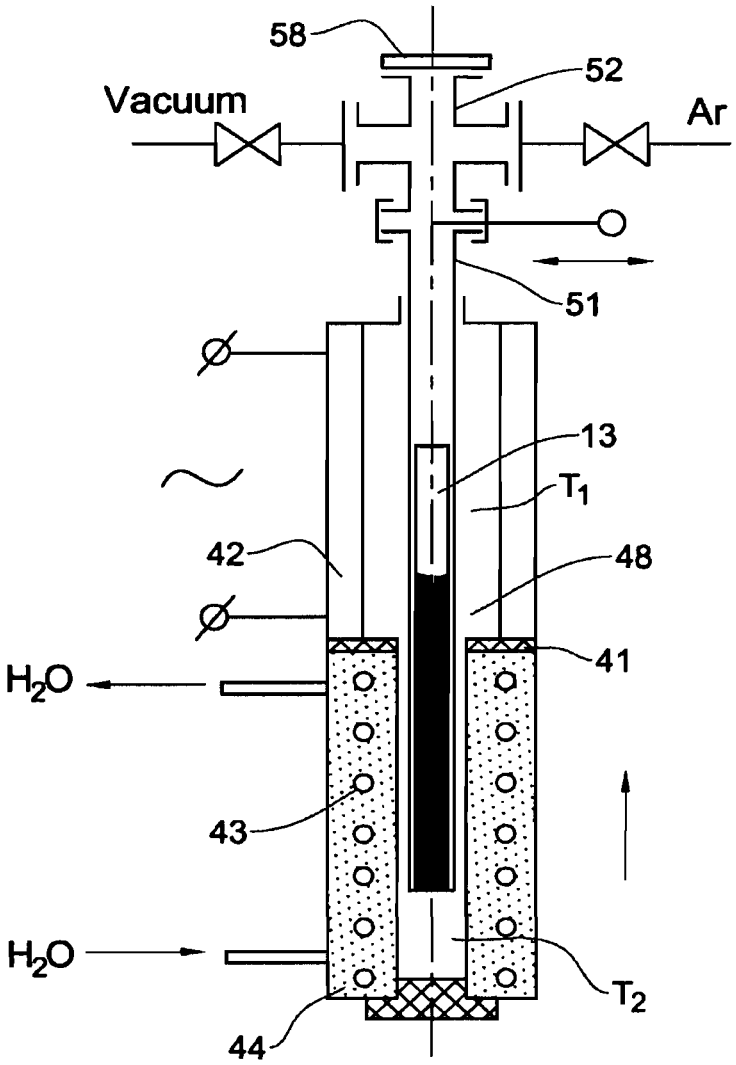
FIG. 5 is a schematic view of an apparatus for directional solidification of alloys of a ternary mixture containing barium, metal and sodium in a vacuum, according to another embodiment of the present invention.

According to another embodiment of the invention, the vertical directional solidification is carried out in an argon atmosphere. Referring to FIG. 5, a schematic view of an apparatus 50 for directional solidification of melts of a ternary mixture containing barium, metal and sodium in an argon atmosphere is shown, according to an embodiment of the present invention. The apparatus 50 differs mainly from the apparatus 40 in FIG. 4 in the fact that it includes a heatproof crucible 51 in which melting and directional solidifying of the melt of the ternary mixture are carried out in an argon atmosphere. For this purpose, the heatproof crucible 51 can be coupled to an argon source (not shown) and to a vacuum system (not shown) through a 4-way cross 52. In operation, the crucible tube 13 with the alloy pieces 41 is placed into the heatproof crucible 51 in argon atmosphere in a glove box (not shown). The heatproof crucible 51 is taken out from glove box with Ar inside the heatproof crucible 51. Then, the crucible 51 is connected to the vacuum system through the 4-way cross 52 for pumping Ar down. Further, the crucible 51 is placed in the furnace 42 for outgassing of the entire growth system at a temperature of about 200° C. Further, the heatproof crucible 51 is filled with Ar and the first temperature is set to the value mentioned above. The crucible-tube is maintained in the argon atmosphere at the first temperature as long as required for re-melting the alloy (i.e., obtaining the alloy of the ternary mixture in a liquid state), thereby allowing the melt to flow by gravity into the mould cavity. The complete melting of the alloy and flowing into the holes (22 in FIG. 3) of the disks (21 in FIG. 3) can, for example, be monitored through a window 53 arranged at the top opening of the 4-way cross 52.

Thereafter, the crucible tube 13 is moved down into the low temperature zone $T_2$ to directionally solidify the melt. The directional solidifying of the melt includes subjecting the crucible-tube with the melt in the argon atmosphere to a second temperature gradually along its length at a predetermined rate as long as required for obtaining the ingot having the getter body of an intermetallic phase and the open-ended voids filled with sodium.

It should be noted that even using very simple means, such as a turbo molecular pump, a glove box, laboratory tube furnaces, and stainless steel tubes with a diameter between 14 mm and 20 mm, it is possible to grow textured ingots of getter material with a mass in the range of about 25 grams to about 200 grams during one production cycle that can be just several hours long. The average cooling rate of the directional solidifying material in the described method can be in the range of about $10^{-1}$ K/s.

Figure 6:
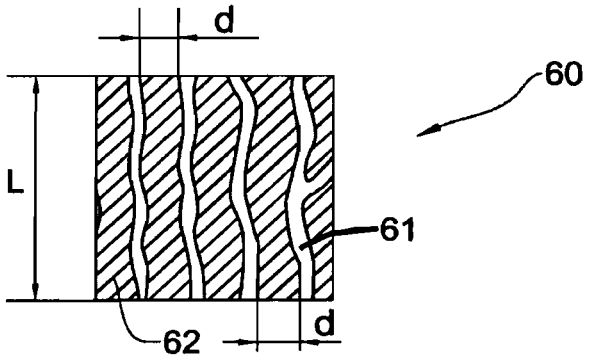
FIG. 6 is a schematic illustration of a textured ingot obtained by the directional solidification of the method of the present application.

FIG. 6 shows a schematic illustration of a micro structure 60 of the ingot obtained by the directional solidification of the melt, as described above. The crystals of the intermetallic phase are indicated by a reference numeral 62. The open-ended voids are indicated by a reference numeral 61. The intermetallic phase 62 is made of intermetallic compounds of barium. The open-ended voids 61 within the intermetallic phase 62 extend along a longitudinal axis of the textured ingot and are filled with sodium, which is evaporated by heat treatment, as described herein below.

In the Ba based alloys of the present application, the characteristic length of the sorption process r is equal to approximately d/2 for bodies with the open-ended voids 61, where d is the width of the continuous solid parts of the carcass 62 of intermetallic compounds of barium between the voids 61. It should be noted that the distance between the "primary or between the secondary dendrite arms" in the material obtained by the solidification of the melt has an order of several micrometers, as a lower dimensional border, which is quite acceptable for the sorption requirements of the invention. In other words, the method of normal directional solidification can satisfy the demand in the art for material with a desired dispersion structure for the desired scale range, namely, it allows the production of materials with a characteristic length of the sorption process r of 1 μm≤r≤100 μm.

After the solidification is completed, the heatproof crucible 51 with the crucible tube (13 in FIG. 4) or a metallic ampoule (45 in FIG. 5) is taken into a glove box, where all further operations are performed in an argon atmosphere.

Figure 7:
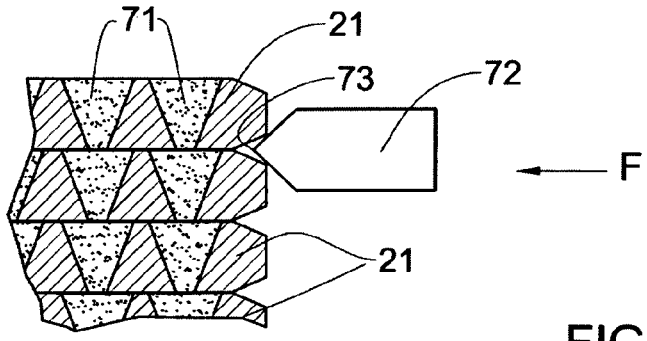
FIG. 7 schematically illustrates granulating of the textured ingot by separating growth disks from each other.

After obtaining the textured ingot, the method for preparation of a getter material includes the step of granulating the textured ingot, thereby obtaining granules having open-ended voids extending therethrough. Referring to FIG. 7, the granulating of the textured ingot includes separating the disks 21 from each other, and disengaging parts 71 of the textured ingot located within the through holes of the adjacent disks from the disks 21.

In operation, the vertically stacked array of disks 21 is released from the crucible tube or metallic ampoule (not shown), and then the disks are separated from each other. The separation of the disks 21, can for example, be carried out by using a wedge 72 or any other suitable tool inserted into a crevice 73 and splitting the ingot by applying a force F. It should be understood that the parts 71 of the textured ingot which are disengaged from the through holes of the disks 21 have a shape of granules that "positively" repeat the shape of the through holes of the disks 21. The granules obtained by the method have substantially regular shapes and uniform dimensions. A value of the overall diameter D can, for example, be in the range of about 3 mm to 12 mm, and be approximately equal to the length H of the granules. A radial dimension of at least a portion of the granules can change along its length for obtaining a narrow neck. A dimension d of the neck of the granule can, for example, be in the range of 1 mm≤d≤3 mm. This dimension d with respect to the maximal diameter D can, for example be in the range of 0.25D≤d≤0.35D. Such provisions can facilitate splitting of the textured material and separation of the disks 21 from each other.

According to an embodiment, the preparation of granules of the getter material of the present invention may include the step of providing a metal gauze and arranging the metal gauze along the walls of the through holes of the disks. For this purpose, a piece of the metal gauze can, for example, be rolled into a tube and placed within the through holes of the disks. Then, the disks assembled into an array can be placed into a crucible tube, and an alloy of the ternary mixture containing barium, metal and sodium can be arranged within the crucible tube above the mould cavity that is defined by the holes of the disks.

A further preparation of the granules is carried out in accordance with the scenario described above. Specifically, the crucible-tube is maintained (either in vacuum or in an argon atmosphere) at a first temperature having a value exceeding the liquidus point of the melt as long as required for obtaining the alloy in a liquid state, thereby allowing the melt to flow by gravity into the through holes of the disks covered with the metal gauze. As a result, the melt is enveloped with the metal gauze.

Figure 8:
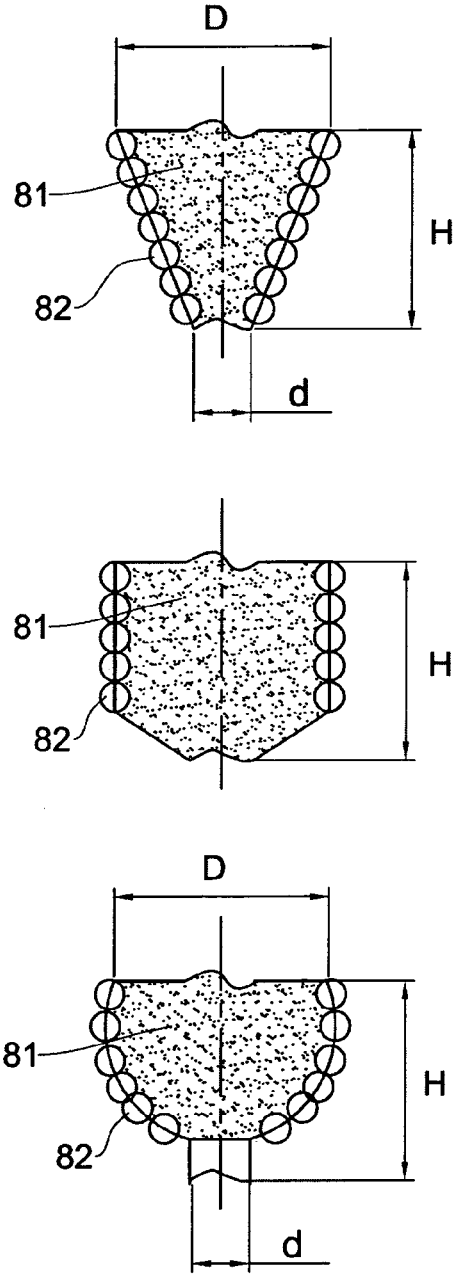
FIG. 8 schematically illustrates granules having the walls enveloped with metal gauze.

Further, the textured ingot can be granulated, as described above, for obtaining granules 81 having the walls enveloped with metal gauze 82, as shown in FIG. 8. It should be understood that the granules enveloped with the metal gauze can have an enhanced strength and hardness. Moreover, the gauze can facilitate the disengagement of the granules from the holes of the disks.

Further, the method for preparation of a getter material of the present invention includes the step of evaporating the sodium located in the open-ended voids from the granules. For this purpose, the granules can, for example, be placed into a sorption pump and thermovacuum treatment is carried out also in the pump. Alternatively, the volatile phase of sodium can be evaporated from the granules in a special evaporation chamber, which can, for example, be located in the same glove box which was used in the earlier method steps. The evaporating of the sodium can, for example, be carried out at a pressure of about $10^{-6}$ mbar and at a temperature in the range of 200° C.-250° C. The evaporation procedure suitable for the purpose of the application is known per se, (see, for example, International Pat. Application WO 2009053969 to Chuntonov), therefore it is not elaborated herein in detail.

It can be summarized that final granules of the getter material represent a getter body made of intermetallic compounds of barium, and open-ended empty voids extending within the getter body. The intermetallic compounds of barium ($BaMe_2$ and BaMe) have a moderate reactivity due to the specific character of the close neighborhood of Ba atoms in the crystal structure of these compounds. This specific character is in fact that the crystal lattice of the mentioned intermetallic compounds contains continuous chains of Ba atoms which directly contact with each other. The type of the structure is, for example, described by M. Fornasini, Acta Cryst., 1975, V. B31, P. 2551-2552. The granules are characterized by a high gas permeability, owing to a plenty of sorption micro channels passing therethrough. The characteristic length between the sorption micro channels r is in the range of 1 μm≤r≤100 μm. A mass of one granule can, for example, be in the range of 50 mg to 2.0 g each.

It is important to note that contrary to most prior art, getter materials operating at high temperatures, sorption of gases by the intermetallic porous granules of the present application, can be carried out at a room temperature spontaneously and irreversibly with almost a constant rate until the major mass of the getter material is reacted. Such kinetics are desirable for most vacuum applications, and, as noted above, are associated with the plurality of micro channels passing through the granules.

The advantages of the new material over conventional material can, for example, be appreciated in the following two applications.

The first example is related to the case in which a long operation time of a getter device is required, whereas the second example deals with a case, in which a small weight of the getter device is most important. The dimensions and designs of the getter devices in these two cases are different. Nevertheless, it should be noted that the getter granules obtained in accordance with the method of the present application can be used with equal success in these different applications, independent of size and type of the device, such as a sorption pump, a gas purifier, etc.

Specifically, the use of the getter material of the present invention is illustrated in getter pumps, although approaches to solutions of sorption problems can also be applied, mutatis mutandis, to other devices, such as gas purifiers, etc.

Figure 9:
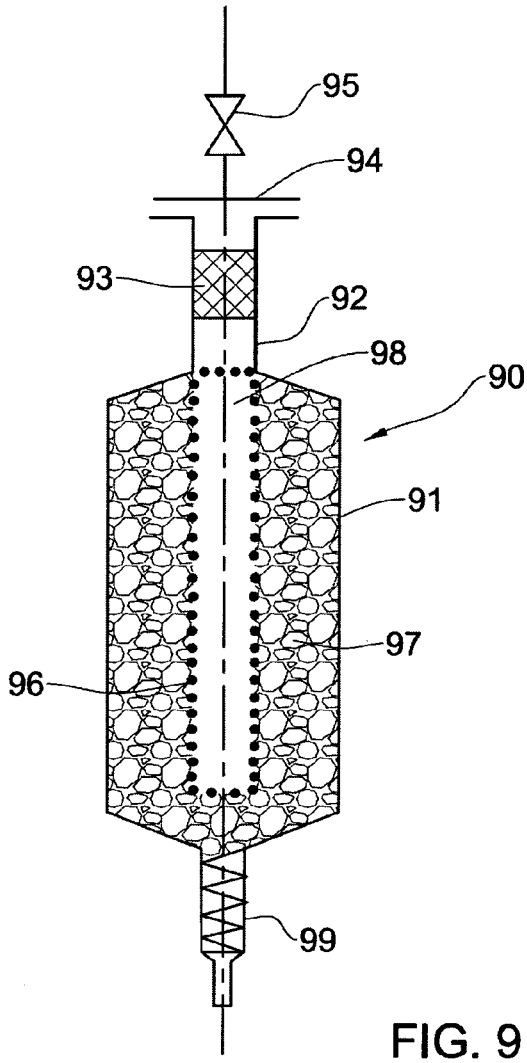
FIG. 9 is a schematic view of an exemplary sorption pump used for a long term operation.

Referring to FIG. 9, a schematic view of an exemplary sorption pump 90 is shown that can utilize the getter material of the present application continuously for several years. The sorption pump 90 includes a housing 91, an outlet pipe 92 containing a filter 93 and is equipped with a pump flange 94 equipped with a valve 95. The housing 91 includes cage 96 arranged in the middle of the housing 91, and granules 97 of the getter material of the present application placed between the inner wall of the housing 91 and the outer wall of the cage 96. The cage 96 defines a free space 98 within the cage 96 and is formed of a metal mesh configured for keeping the free space 98 from getting the granules 97 into the free space 98. The free space is required for the uniform distribution of gas molecules through the volume occupied by the granules 97. In operation, the gas molecules flow into the free space 98 from the vacuum chamber through the filter 93. The sorption pump 90 also includes an inlet tube 99 configured for filling the sorption pump 90 with the granules 97 of the getter material.

The sorption pump 90 can, for example, be filled with the getter material through the tube 99 in a glove box in an argon atmosphere, while the outlet pipe 92 is closed. After filling the pump with the getter material, the tube 99 is connected to the vacuum line for evacuation of Ar and is then sealed. The sealing can, for example, be carried out by pinching the pipe and cutting it out from the vacuum line, as described by K. Chuntonov et al., J. Less-Common Metals, 1982, V. 83, P. 143-153. The pump is thereby ready for being connected to a vacuum chamber or for its conservation after a secondary filling with argon.

It should be noted that the filter 93 can serve not only for interception of small particles, but can also function as a dryer, trapping the water vapor on its way into the granules 97. In this case, the pump is filled with the granules before the evaporation step, so that the evaporation of the volatile phase (i.e., Na) is carried out directly in the housing 91. Specifically, the pump is connected to a vacuum system, and during the pumping out, the housing is heated to about 250° C., while the outlet pipe 92 of the pump with the filter 93 is cooled down to room temperature. Accordingly, Na vapor condenses on the inner surface of the channels (not shown) of the filter 93, and then this condensate is oxidized to create $Na_2O$, by feeding oxygen under vacuum at the partial pressure from about $10^{-3}$ mbar to about $10^{-5}$ mbar (see, for example International Pat. Application WO 2009053969 to Chuntonov).

It should be noted that the pumps described above can pump down active gases (including the air) at room temperature to the amount of about 320 Vatm (i.e., 320 volumes of gas at the pressure of one atmosphere), where V is the total inner volume of the pump. After exhausting its resource, the pump can be repeatedly reloaded, since the granules of the getter material can be easily washed with a water solvent.

Figure 10:
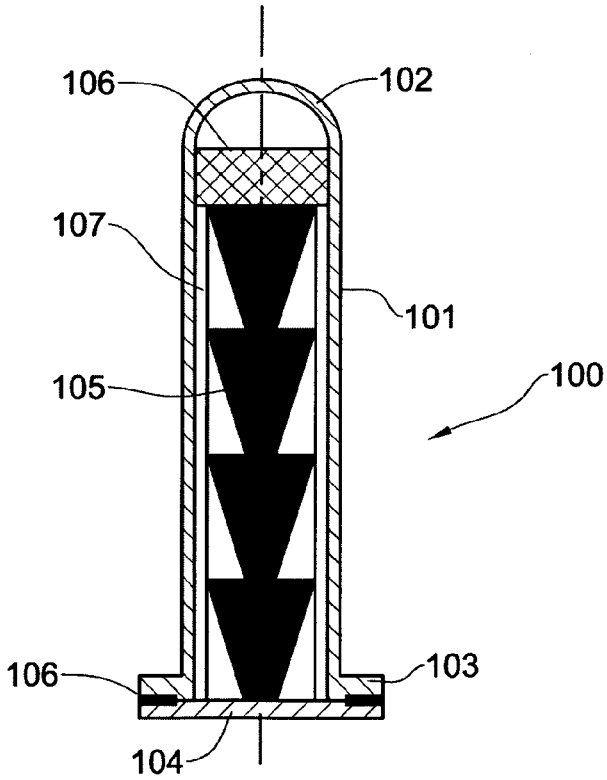
FIG. 10 is a schematic view of an exemplary sorption pump of a finger type.

Referring to FIG. 10, a schematic view of an exemplary sorption pump 100 of a finger type is shown. The finger sorption pump 100 is aimed to work for a period of several tens to several hundreds of hours and is convenient for fast replacement under field conditions.

The finger sorption pump 100 includes a cylindrical housing 101 sealed at one end 102, and a pump flange 103 arranged at the other end to the blank 104 of the cylindrical housing 101. The cylindrical housing 101 includes a getter column 105 containing several granules of the getter material with a total mass of about 0.5 g to about 2.0 g. The finger sorption pump 100 further includes a porous filter 106, arranged at the sealed end 102 and a separation member 107 configured to create a space between the inner wall of the housing 101 and the getter column 105 for passing gas molecules therethrough. According to an embodiment, the separation member 107 includes a few needles, for example, 3-5 needles can be used for creating the suitable space.

The pump 100 can be assembled in an argon atmosphere. After assembling, the housing 101 is sealed in a vacuum, for example, in the same manner as a bonding machine, used for manufacturing of vacuum package MEMS. The housing filled with granules is evacuated in the presence of a small gap between the pump flange 103 and the blank 104. Then, the blank 104 is pressed against the flange 103 to form a vacuum tight connection 106. If the housing is made of plastic, the regions of seaming the material should be heated. On the other hand, if the housing is metallic, the hermiticity of the connection between the flange and the bottom can be achieved by various methods, including brazing, cold pressing, using chargers with an elastic gasket and even by gluing at room temperature. Ready to be used mini pumps should be stored in vacuum cabinets.

Figure 11:
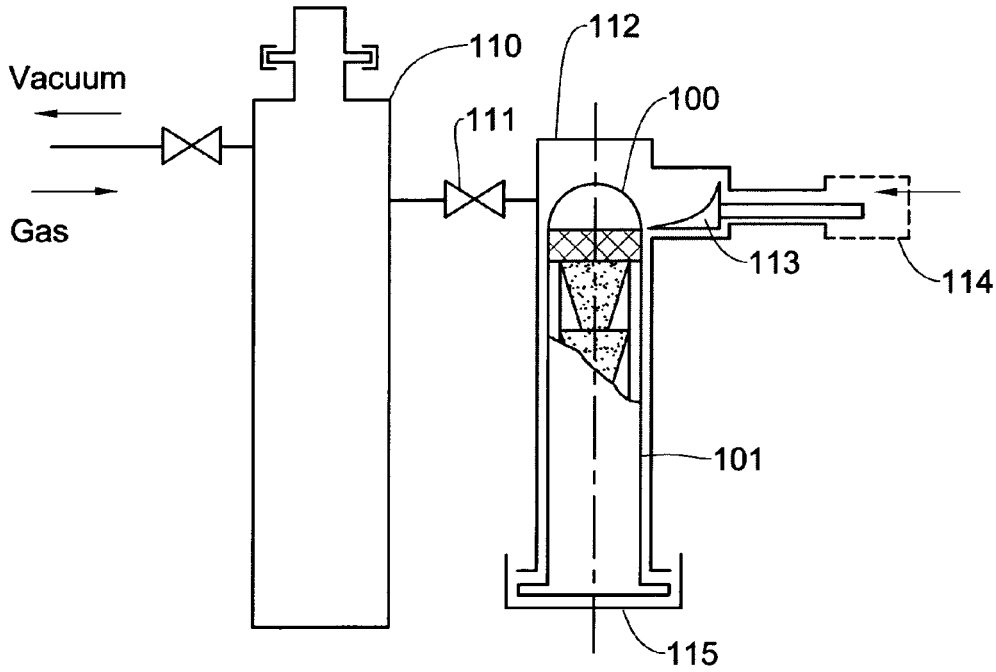
FIG. 11 schematically illustrates connection of the getter pump to a portable vacuum device.

Referring to FIG. 11, a schematic view of connecting of the getter pump 100 to a portable vacuum device 110 is illustrated. Replacement of a used finger sorption pump with a new one is carried out in the following way. A valve 111, which is arranged between a vacuum chamber of the device 110, and a getter container 112 is closed. A knife 113 is moved to the starting position to provide space for removing the used getter pump 100 and replacing it with a new one. A seal nut 115 is unscrewed and the used getter pump 100 is taken out.

Further, the actions follow in a reverse order. A new getter pump is placed into the getter container 112, and the seal nut 115 is tightly screwed again providing hermeticity of the getter container 112. A part of the spherical top of sealed end of the housing 101 is cut and simultaneously bended up with the knife 113. Finally, after a short exposure time, during which the getter material pumps a small amount of the air which entered the housing out, the valve 111 is opened.

As such, those skilled in the art to which the present invention pertains, can appreciate that while the present invention has been described in terms of preferred embodiments, the concept upon which this disclosure is based may readily be utilized as a basis for the designing of other structures and processes for carrying out the several purposes of the present invention.

The described above method of production of gas permeable granules can be used with other getter alloys as well. Examples of such alloys include, but are not limited to, intermetallic compounds of Ca, Sr, solid solutions of Li, etc. Inherent to each of the mentioned alloys sorption selectivity along with their high gettering effectiveness at room temperature, provide new challenges for the technology of producing super pure gases.

Figure 12A:
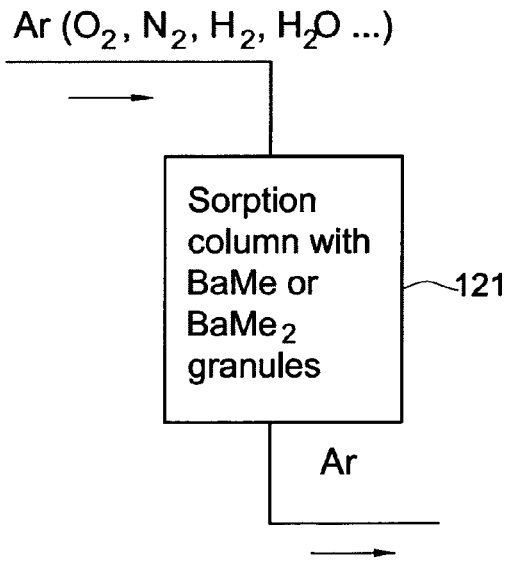
FIGS. 12A and 12B schematically illustrate purification schemes in a flow-type apparatus.
Figure 12B:
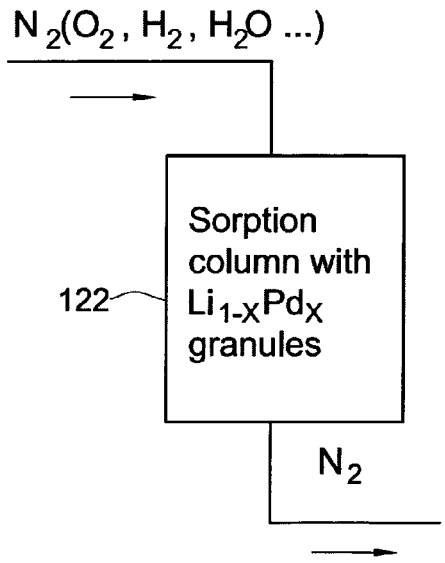

Thus, if the intermetallic granules of BaMe and $BaMe_2$ represent a good tool purification of flows of noble gases from active impurities (see FIG. 12A), then the granules based on Li, Ca, Mg, etc. provide the possibility to purify certain active gases, e.g., $H_2$, $N_2$, $CO_2$, etc (see FIG. 12*b*). FIG. 12A shows a purification scheme of Ar by using Ba-based granules. The gas mixture reacts with atoms of Ba, forming a layer of nonvolatile compounds on the surface of Ba material at room temperature. As a result, a high purity Ar gas is collected at the outlet of a sorption column 121.

FIG. 12B schematically illustrates a purification scheme through a sorption column 122, which is filled with porous granules of $Li_{1-x}Pd_x$, where $0.15 \le x \le 0.5$. In this case, all the components of the gas mixture (except $H_2$ and $N_2$) are absorbed by Li and form a layer of chemical compounds on the surface of the granules. In turn, sorption of $H_2$ is carried out in the two following ways: (i) partially by dissolving in the crystallic lattice of the intermetallic components of the alloy (see, for example, Sakamoto Y., Nakamura R., Ura M., J. Alloys Compd., 1995, V. 231, P. 553), and (ii) partially by dissolving in metallic "islands" of Pd which appear after withdrawal of atoms of Li into the layer of products. Accordingly, for a sufficiently slow flow rate, a nitrogen of very high purity can be obtained at the outlet of the sorption column 122.

The mentioned method is also suitable for the production of granulated catalysts having a high specific surface area or for the production of hydrogen storage materials, e.g. for the production of composition of $CuMg_2$ and $Mg_2Ni$, etc. These compositions can, for example, be produced by using the method of quenching the droplets with the further sublimation of the excess Mg, as described in US Pat. Appl. Publication No. 2006/0225817 to K. Chuntonov. Likewise, these compositions can be produced by the method of vertical directional solidification and the further vacuum evaporation of the earlier introduced into the alloy sodium, as described in the present application.

Also, it is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present description.

The invention claimed is:

1. A method for preparation of a getter material based on intermetallic compounds of barium, comprising:

preparing a melt of a ternary mixture containing barium, metal and sodium;

directionally solidifying the melt to produce a textured ingot comprising:

a getter body made of intermetallic compounds of barium; and open-ended voids within the getter body, said open-ended voids extending along a longitudinal axis of said textured ingot and filled with the sodium;

granulating the textured ingot, thereby obtaining granules having the open-ended voids extending therethrough;

and evaporating the sodium from the granules by applying a thermovacuum treatment to the granules.

2. The method of claim 1, wherein the ternary mixture is selected from the group consisting of $(BaMe)_{1-y}Na_y$ and $(BaMe_2)_{1-y}Na_y$, where $0.05 \le y \le 0.15$.

3. The method of claim 1, wherein said ternary mixture is selected from the group consisting of $(Al_{1-x}Ba_x)_{1-y}Na_y$, where $0.37 \le x \le 0.40$, $0.05 \le y \le 0.15$; and $(Ba_xMg_{1-x})_{1-y}Na_y$, where $0.27 \le x \le 0.33$, $0.05 \le y \le 0.15$.

4. The method of claim 1, wherein the step of preparing of the melt of the mixture of the intermetallic compounds of barium together with sodium comprises:

providing an alloy of a ternary mixture containing barium, metal and sodium;

providing a mold having a mold cavity of a predetermined shape;

arranging the alloy of the ternary mixture above the mold cavity;

sealing the arrangement comprising the alloy arranged above the mold in an ampoule in a vacuum; and maintaining the ampoule at a first temperature having a value exceeding the liquidus point of the melt as long as required for obtaining the alloy of the ternary mixture in a liquid state, thereby allowing the melt to flow into the mold cavity.

5. The method of claim 4, comprising providing a metal gauze and arranging the metal gauze along a wall of the mold cavity before arranging the alloy of the ternary mixture above the mold cavity in the crucible tube, thereby to envelop the melt with the metal gauze after the maintaining the ampoule at the first temperature.

6. The method of claim 4, wherein the step of directionally solidifying of the melt includes subjecting the ampoule with the melt to a second temperature gradually along its length at a predetermined rate as long as required for obtaining the textured ingot having the getter body of an intermetallic phase and the open-ended voids filled with sodium, the second temperature having a value below the solidus point of the melt.

7. The method of claim 6, wherein the first temperature is greater than the liquidus point of the melt by 40-60 degrees Celsius, whereas the second temperature is less than the solidus point of the melt by 10-20 degrees Celsius.

8. The method of claim 4, wherein the mold comprises a vertically stacked array of disks, each disk comprising at least one through hole having a predetermined shape and arranged coaxially of the through hole of the adjacent disks, thereby forming said mold cavity.

9. The method of claim 8, wherein a radial dimension of at least a portion of the at least one through hole changes along a hole length.

10. The method of claim 8, wherein the step of granulating of the textured ingot comprises:

separating the disks of said plurality of disks from each other; and disengaging parts of the textured ingot located within the through holes of the adjacent disks from the disks.

11. The method of claim 1, wherein the step of preparing of the melt of the mixture of the intermetallic compounds of barium together with sodium comprises:

providing an alloy of a ternary mixture containing barium, metal and sodium;

providing a mold having a mold cavity of a predetermined shape;

providing a crucible tube arranging the alloy of said ternary mixture above the mold cavity in the crucible tube;

placing the arrangement comprising the crucible tube containing the alloy arranged above the mold in an argon atmosphere; and maintaining the crucible-tube in the argon atmosphere at a first temperature having a value exceeding the liquidus point of the melt as long as required for obtaining said alloy of the ternary mixture in a liquid state, thereby allowing the melt to flow by gravity into the mold cavity.

12. The method of claim 11, comprising providing a metal gauze and arranging the metal gauze along a wall of the mold cavity before the placing of the arrangement in the crucible-tube, thereby to envelop the melt with the metal gauze after said maintaining the ampoule at the first temperature.

13. The method of claim 11, wherein the directionally solidifying of the melt includes subjecting the crucible-tube with the melt in an argon atmosphere to a second temperature gradually along its length at a predetermined rate as long as required for obtaining the ingot having the getter body of an intermetallic phase and the open-ended voids filled with sodium, said second temperature having a value below the solidus point of the melt.

14. The method of claim 1, wherein the step of evaporating of the sodium is carried out at a pressure of about $10^{-6}$ mbar and at a temperature in the range of 200° C.-250° C.

15. A getter material based on intermetallic compounds of barium, comprising granules having a getter body made of the intermetallic compounds, and open-ended voids extending therethrough, thereby defining sorption channels, wherein the getter material is obtainable by a method according to claim 1, wherein the ternary mixture is selected from $(BaMe)_{1-y}Na_y$, and $(BaMe_2)_{1-y}Na_y$, where $0.05 \le y \le 0.15$, $(AI_{1-x}Ba_x)_{1-y}Na_y$, where $0.37 \le x \le 0.40$, $0.05 \le y \le 0.15$, and $(Ba_xMg_{1-x})_{1-y}Na_y$, where $0.27 \le x \le 0.33$, $0.05 \le y \le 0.15$.

16. The getter material of claim 15, wherein the granules have substantially regular shapes and uniform dimensions.

17. The getter material of claim 15, wherein an overall dimension of the granules is in the range of 3 mm to 12 mm.

18. The getter material of claim 15, wherein a distance between the open-ended voids extending through the granules is in the range of about 1 micrometer to about 100 micrometers.

19. The getter material of claim 15, further comprising a metal gauze enveloping at least partially the granules.

20. A process of gettering of residual gases in a vacuum chamber, comprising the step of: providing a sorption pump comprising a getter material based on intermetallic compounds of barium, comprising granules having a getter body made of the intermetallic compounds, and open-ended voids extending therethrough, thereby defining sorption channels, wherein the getter material is obtainable by a method according to claim 1, wherein the ternary mixture is selected from $(BaMe)_{1-y}Na_y$ and $(BaMe_2)_{1-y}Na_y$, where $0.05 \le y \le 0.15$, $(AI_{1-x}Ba_x)_{1-y}Na_y$, wherein $0.37 \le x \le 0.40$, $0.05 \le y \le 0.15$, and $(Ba_xMg_{1-x})_{1-y}Na_y$, where $0.27 \le x \le 0.33$, $0.05 \le y \le 0.15$, and connecting the sorption pump to a vacuum line of the vacuum chamber.

21. A process of purification of a gas stream, comprising the step of flowing a gas of the gas stream through a getter material based on intermetallic compounds of barium, comprising granules having a getter body made of the intermetallic compounds, and open-ended voids extending therethrough, thereby defining sorption channels, wherein the getter materials is obtainable by a method according to claim 1, wherein the ternary mixture is selected from $(BaMe)_{1-y}Na_y$ and $(BaMe_2)_{1-y}Na_y$, where $0.05 \le y \le 0.15$, $(AI_{1-x}Ba_x)_{1-y}Na_y$, where $0.37 \le x \le 0.40$, $0.05 \le y \le 0.15$, and $(Ba_xMg_{1-x})_{1-y}Na_y$, where $0.27 \le x \le 0.33$, $0.05 \le y \le 0.15$.

* * * * *